US008776312B2

(12) United States Patent
Overholt et al.

(10) Patent No.: US 8,776,312 B2
(45) Date of Patent: Jul. 15, 2014

(54) AIR FLOW PATH TO COOL A VACUUM CLEANER BELT

(75) Inventors: Jonathan Overholt, Cookeville, TN (US); Charles Jeff Morgan, Sparta, TN (US); Bruce Kiern, Cookeville, TN (US); Victor Brent McClearen, Cookeville, TN (US)

(73) Assignee: Techtronic Floor Care Technology Limited, Tortola (VG)

( * ) Notice: Subject to any disclaimer, the term of this patent is extended or adjusted under 35 U.S.C. 154(b) by 477 days.

(21) Appl. No.: 13/099,085

(22) Filed: May 2, 2011

(65) Prior Publication Data

US 2012/0279011 A1 Nov. 8, 2012

(51) Int. Cl.
*A47L 5/12* (2006.01)

(52) U.S. Cl.
USPC ..... 15/413

(58) Field of Classification Search
CPC ..... A47L 9/0081
USPC ..... 15/413
IPC ..... A47L 5/12,5/22
See application file for complete search history.

(56) References Cited

U.S. PATENT DOCUMENTS 2,184,446 A * 12/1939 Snyder ..... 15/413
5,551,122 A * 9/1996 Burkhardt et al. ..... 15/344

* cited by examiner

*Primary Examiner* — David Redding
(74) *Attorney, Agent, or Firm* — Michael Best & Friedrich LLP

(57) ABSTRACT

A vacuum cleaner with a cooled drive belt is described. The vacuum has a handle, body, base housing, cooling fan, motor, drive belt and a drive belt housing. A fan draws ambient air over a drive belt within the belt housing. The belt housing can have a main belt housing and a belt housing cover. The belt housing can contain an air intake and air exhaust connected by an air duct. Belt housing can have a filter in order to clean intake air. The result is a vacuum with significantly greater longevity—reducing costs and increasing reliability of the vacuum for the user.

19 Claims, 6 Drawing Sheets

AIR FLOW PATH TO COOL A VACUUM CLEANER BELT

TECHNICAL FIELD

The present teachings are directed toward the improved longevity of vacuum cleaners. In particular, the disclosure relates to an intake air flow path in a vacuum cleaner that cools a vacuum cleaner drive belt.

BACKGROUND

A need has been recognized in the vacuum cleaner industry for a vacuum cleaner with increased longevity for one or more movable parts. Vacuum cleaners are made up of many moving parts, including motors, fans and belts. Repeated usage of a vacuum cleaner may lead to the failure of one or more of the movable parts. In many cases, the expense of repairing the vacuum exceeds the cost of replacing the unit. In other cases, because replacement parts are not easily accessible, the time required to replace the failed part is unacceptable to the user. Thus, an improved vacuum cleaner needs to function reliably for a longer period than normal.

The prior art vacuum cleaners often utilize drive belts to drive, for example, beater bars or rotating brushes. Optimum performance of the drive belt is a balance between the rotational speed of the motor and the beater bar along with the tension applied to the belt. The drive belts are made of pliable material and can wear down and break with extended use. The prior art vacuums often have the drive belts exposed to heat generated by the vacuum motor. Also, friction between a belt and a drive shaft can generate a lot of wear and heat. This problem is more exacerbated when the motors are spun at higher revolutions. For example, vacuum motors can rotate at approximately 16,000 to 24,000 rotations per minute (RPM). Beater bars can rotate at, for example, approximately 5,000-8,000 RPM. The heat and speed can cause drive belts to degrade and wear. Some prior art vacuums can have the drive belts exposed to dirty debris-filled air. As the result of heat and debris exposure, the drive belt can fail, rendering the vacuum cleaner non-functional. Replacing vacuum cleaner belts is not always easy or cost effective. The prior art does not, however, exemplify vacuum cleaners with mechanisms that prolong the longevity of the vacuum cleaner by cooling and protecting the drive belt in order to prevent the degradation of the drive belts utilized. The present invention meets this need.

SUMMARY

According to one embodiment, a vacuum cleaner is described. The vacuum cleaner comprises a vacuum cleaner base housing including a base housing air intake; a motor comprising a shaft adapted to receive a drive belt, wherein the motor is disposed in the vacuum cleaner base housing; a drive belt housing including an opening to receive the shaft; a drive belt housing air exhaust disposed proximate the opening; and a drive belt housing air intake disposed remote from the opening, wherein an air flow path defined between the drive belt housing air intake and the drive belt housing air exhaust overlaps a drive belt path, and the base housing air intake communicates with the belt housing air exhaust. The drive belt housing can define a narrow passage at one or more cross-section for the belt and air to flow through. The narrow passageway can forcibly cool the belt. In some embodiments, the drive belt can comprise a V-belt.

In some embodiments, the vacuum cleaner further comprises a cooling fan disposed on the shaft. In some embodiments, the vacuum cleaner further comprises a cooling fan, and wherein the shaft extends from both ends of the motor, the cooling fan is disposed on one end of the motor and the drive belt housing is disposed on the other end of the motor.

In some embodiments, the vacuum cleaner further comprises an impeller disposed on the shaft. The impeller can be disposed in a volute or a scroll to create suction that collects debris and delivers it to a debris collection device, such as a bag.

In some embodiments, the vacuum cleaner further comprises a drive belt and a beater bar driven by the drive belt.

In some embodiments, the vacuum cleaner further comprises a motor support disc disposed proximate to the base housing air intake. The motor support disc can include openings to allow for air flow to flow through the inside of the motor. The motor support disc can also buttress an outer housing of the motor. The motor support disc can also keep the shaft centered.

In some embodiments, the belt housing comprises magnesium.

In some embodiments, the vacuum cleaner further comprises a filter disposed on the belt housing air intake. In some embodiments, the filter is removable. In some embodiments, the filter is washable.

In some embodiments, the vacuum cleaner further comprises a base housing exhaust that is disposed remote from the base housing air intake.

In some embodiments, the operational Mean Time Between Failure (MTBF) of a drive belt of the vacuum is greater than the operational MTBF of the rest of the vacuum. In alternate embodiments, the operational MTBF of a drive belt disposed within the drive belt housing increases at least 40% as compared to an operational MTBF of an identical drive belt not disposed within the drive belt housing. In additional embodiments, the operational MTBF of a drive belt disposed within the drive belt housing is at least two times greater than an operational MTBF of a drive belt not disposed within the drive belt.

In some embodiments, the vacuum cleaner is an upright vacuum cleaner.

BRIEF DESCRIPTION OF THE DRAWINGS

The same reference number represents the same element on all drawings. It should be noted that the drawings are not necessarily to scale. The foregoing and other objects, aspects, and advantages are better understood from the following detailed description of a preferred embodiment of the invention with reference to the drawings, in which.

DETAILED DESCRIPTION

The present teachings provide a vacuum cleaner including improved longevity features. The essential structure of the vacuum comprises a handle, body, base housing, cooling fan, motor, drive belt and a drive belt housing. A cooling fan draws ambient air from the belt housing intake, through the belt housing exhaust, and into the base housing intake, such that the air overlaps a drive belt within the belt housing. The airflow reduces the amount of heat generated by the motor that the drive belt is exposed to. In some embodiments, the air flows across a width of a drive belt. In alternate embodiments, the air flows along a length of a drive belt. In some embodiments, the belt housing can have an air filter. Thus, airflow drawn into the belt housing is cleaned prior to entering the drive belt housing and overlapping the drive belt. Moreover the filtered air can be passed through to the base vacuum cleaner housing.

The result is a vacuum cleaner with significantly greater longevity. Since the drive belt is protected from debris and is cooled by the air traveling in through the belt housing air intake, the mean time between failure of the drive belt is increased. The increase in the MTBF of the drive belt results in decreased costs associated with the vacuum and longer reliability for the user.

For the purposes herein, MTBF refers the predicted elapsed time between inherent failures of a system during operation. MTBF can be calculated as the arithmetic mean (average) time between failures of a system.

For the purposes herein, "system" refers to a vacuum, and all of its parts. All individual parts of a vacuum can have an inherent MTBF. Additionally, the vacuum cleaner as a whole can have a MTBF.

For the purposes herein "failure" of a system, vacuum or part of a vacuum refers to an event or action wherein the system, vacuum, or part of a vacuum is rendered unusable by a user. In a non-limiting example, if a drive belt breaks, rendering a beater bar to not turn, the drive belt has "failed." In another example, if a motor overheats and fails to generate power, the motor has "failed."

For the purposes herein "belt" and "drive belt" are synonymous and are used interchangeably.

Figure 1:
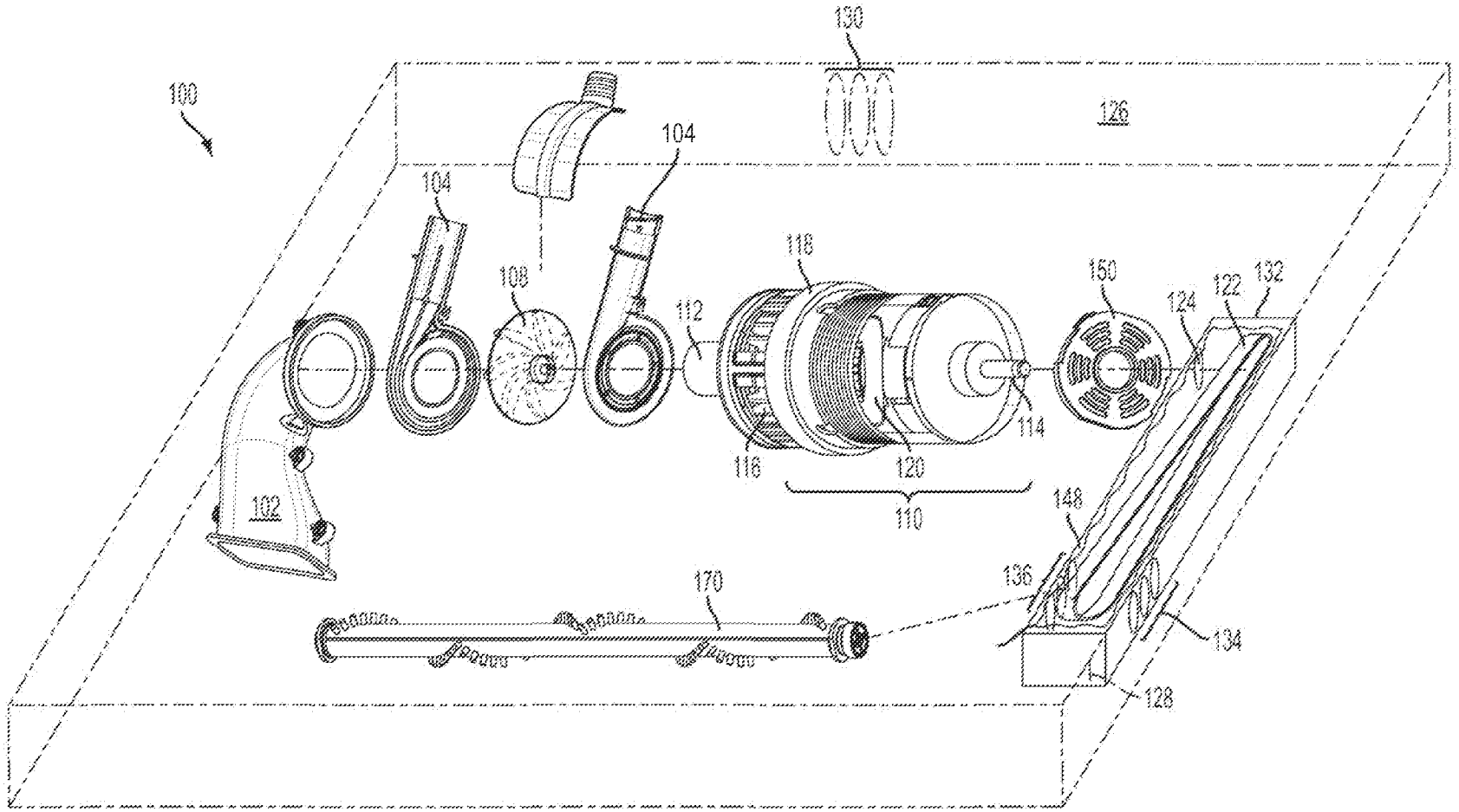
FIG. 1 illustrates an exploded view of a vacuum cleaner according to one embodiment.

FIG. 1 is a perspective exploded view of an exemplary embodiment of a vacuum cleaner 100. Dashed box 126 represents a vacuum housing base as known in the art. In some embodiments, vacuum cleaner 100 comprises a dirty air intake 102 which transports debris from a cleaning surface into and through volute 104. Dirty air can be drawn into the dirty air intake 102 and blown out from the top of volute 104 via impeller 108. Dirty air is collected by a debris receptacle (not shown) which is in communication with the top of volute 104. In one embodiment, vacuum cleaner 100 comprises motor assembly 110. Motor assembly 110 can comprise a shaft extending from both sides. The shaft can comprise an impeller shaft 112 and a belt shaft 114. Impeller 108 and cooling fan 116 can be disposed on impeller shaft 112. Motor assembly 110 can further comprise motor housing 118 and coils 120. Belt shaft 114 and/or impeller shaft 112 can be flat or grooved. The diameter of belt shaft 114 can be greater than, equal to, or less than the diameter of impeller shaft 112. The diameter of impeller shaft 112 can be greater than, equal to, or less than the diameter of belt shaft 114. In some embodiments, belt shaft 114 and/or impeller shaft 112 can have detents or stops in order to control drift of drive belt 122. Drive belt 122 can rotate a brush or beater bar 170.

In some embodiments, belt housing exhaust 124 can create a cooling air duct between belt housing air intake 134 and vacuum housing air exhaust 130. The opening for belt housing exhaust 124 can vary in size and can be larger than depicted in FIG. 1. For example, the opening can be the same diameter as motor support disc 150. Belt housing air exhaust 124 can be located proximate to motor support disc 150 in this example. The cooling air duct can include one or more additional belt housing air exhaust openings 136, and a vacuum housing air intake 128, which can be in direct connection.

In some embodiments, belt housing 132 is separate from vacuum housing 126. In other embodiments, belt housing 132 can be a portion of vacuum housing 126 or an extension of vacuum housing 126. Belt housing 132 can be a compartment of vacuum housing 126.

Airflow generated by cooling fan 116 can travel into belt housing air intake 134, through belt housing air duct 148, out through belt housing air exhaust 124, through motor support disc 150, over motor assembly 110, and exits through vacuum housing air exhaust 130. As such, airflow cools drive belt 122 disposed within belt housing 132. After exiting motor assembly 110, the same airflow can cool other components disposed within vacuum housing 126.

Figure 2:
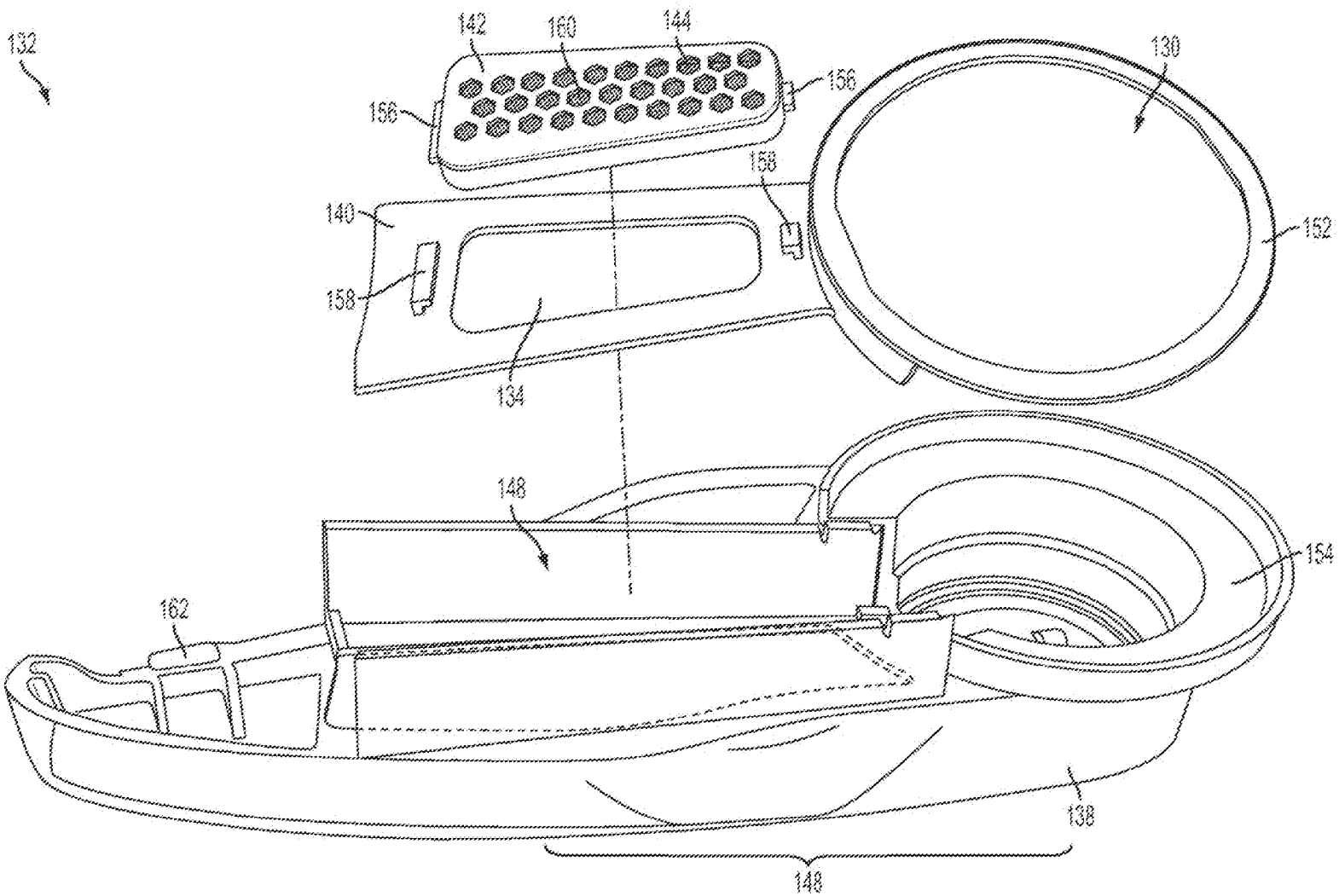
FIG. 2 illustrates an exploded view of a belt housing of a vacuum cleaner according to one embodiment.

FIG. 2 is a perspective exploded view of an exemplary embodiment of belt housing 132. As mentioned above, belt housing 132 can comprise main belt housing 138 and belt housing cover 140. Main belt housing 138 can contain belt housing air exhaust 130. Main belt housing 138 can have a beater bar (not shown) disposed at the end opposite of the belt housing air exhaust 138. Belt housing cover 140 can have belt housing air intake 134. Belt housing air intake 134 can be covered with filter cover 142. Filter cover 142 can be secured to belt housing cover 140 by tabs 156 on filter cover 142 which fit under below hooks 158 on belt housing cover 140. Filter cover 142 can have a single or multiple apertures 160 which allow air to flow into belt housing air duct 148. Filter cover 142 can be removable and/or washable. Belt housing cover 140 comprises circular portion 152 which connects to circular ledge 154 of main belt housing 138 when belt housing 132 is assembled. Belt housing air duct 148 can be formed when belt housing 132 is assembled, and can have a smooth surface in order to reduce air resistance and drag. Beater bar opening 162 can allow a beater bar to enter belt housing 132.

Belt housing 132 can be assembled from main belt housing 138 and belt housing cover 140. The parts may be held together in any suitable manner, such as friction fit tabs (not shown) and slots (not shown) to receive the tabs. Alternatively, the parts may be held together using fasteners, such as screws or rivets. In a preferred embodiment, belt housing 132 is held together by a screw affixing belt housing 132 to a vacuum cleaner housing. This can advantageously prevent belt housing 132 from disassembly via vibrations caused by regular usage of vacuum cleaner 100. Preferably, the clearance between a drive belt and the interior wall of the belt housing provides adequate space for the rotation of the belt while allowing air to pass through without much hindrance. However, the clearance between a drive belt and the interior wall of the belt housing is not so great that air that passes through is unable to suitably cool the drive belt. In one preferred embodiment, the width of belt housing 132 is approximately about 1 inch, and the width of drive belt 122 is approximately inch.

In some embodiments, belt housing exhaust 124 can create a cooling air duct between belt housing air intake 134 and vacuum housing air exhaust 130. The duct can provide a small clearance between duct walls and the belt travel path. Belt housing air exhaust 124 can be located proximate to motor support disc 150 in this example. The cooling air duct can include one or more additional belt housing air exhaust openings 136 and a vacuum housing air intake 128, which can be in direct connection.

In some embodiments, belt housing 132 is separate from vacuum housing 126. In other embodiments, belt housing 132 can be a portion of vacuum housing 126 or extension of vacuum housing 126. Belt housing 132 can be a compartment of vacuum housing 126.

Airflow generated by cooling fan 116 can travel into belt housing air intake 134, through belt housing air duct 148, out through belt housing air exhaust 124, through motor support disc 150, over motor assembly 110, and exit through vacuum housing air exhaust 130. In some embodiments, belt housing air intake 134 is directly across from belt housing air exhaust 124. In alternate embodiments, belt housing air intake 134 is located on the opposite end of belt housing air exhaust 124. In some embodiments, belt housing air intake 134 and belt housing air exhaust 124 are located on the same lateral surface (side) of belt housing 132. Strategic placement of belt housing air intake 134 and belt housing air exhaust 124 allows for focused airflow across the width or length of drive belt 122. As such, airflow advantageously cools the drive belt 122 disposed within belt housing 132. After exiting motor assembly 110, the same airflow can cool other components disposed within vacuum housing 126.

Figure 4A:
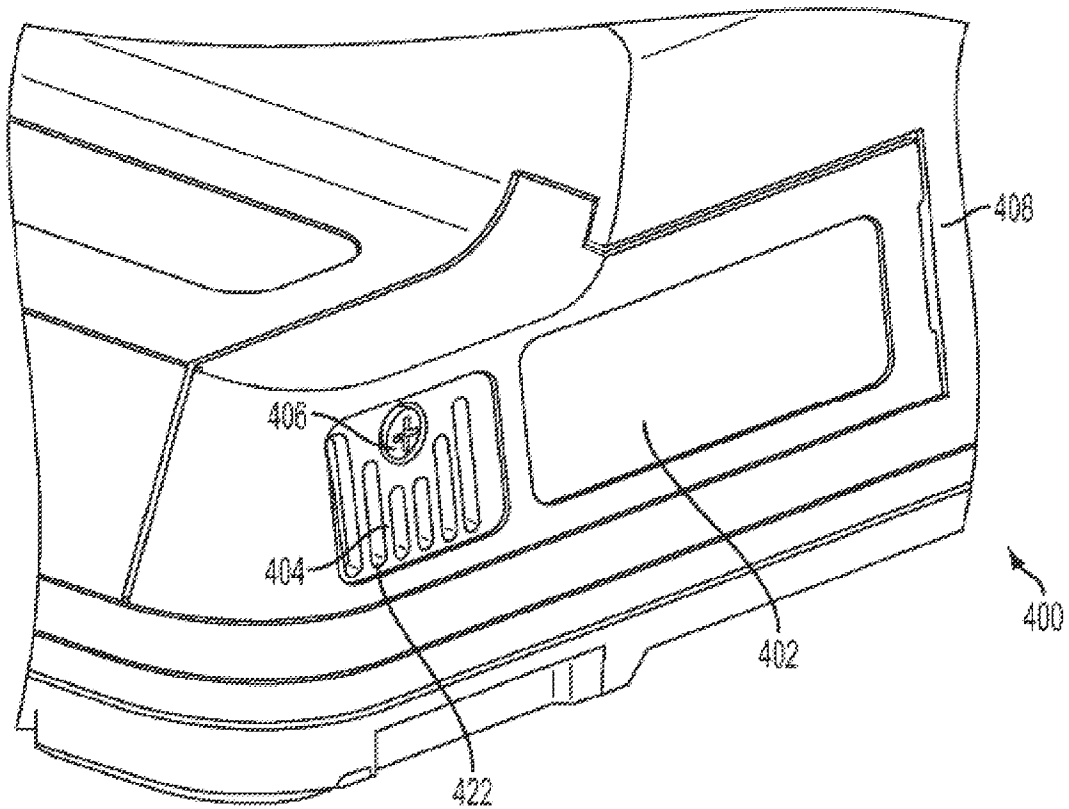
FIGS. 4A-4C illustrate a perspective view of a vacuum cleaner according to one embodiment.
Figure 4B:
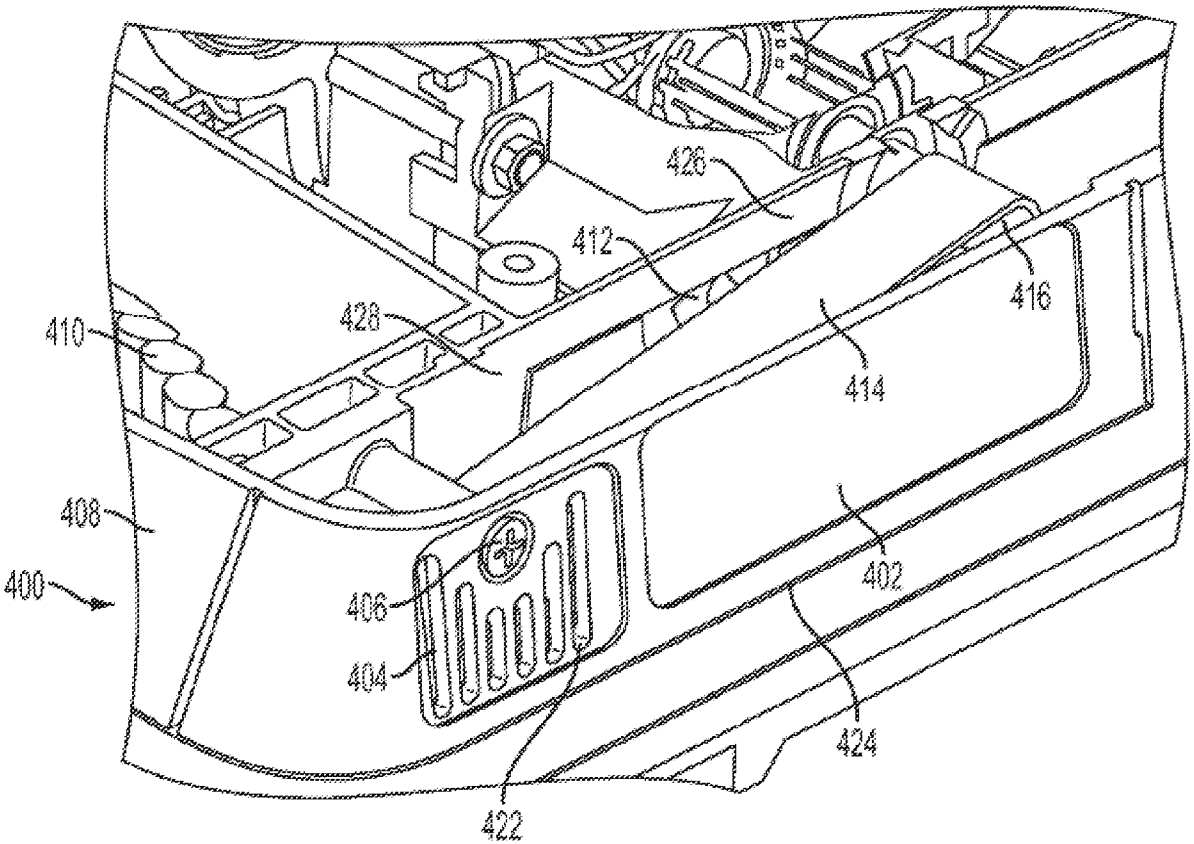
Figure 4C:
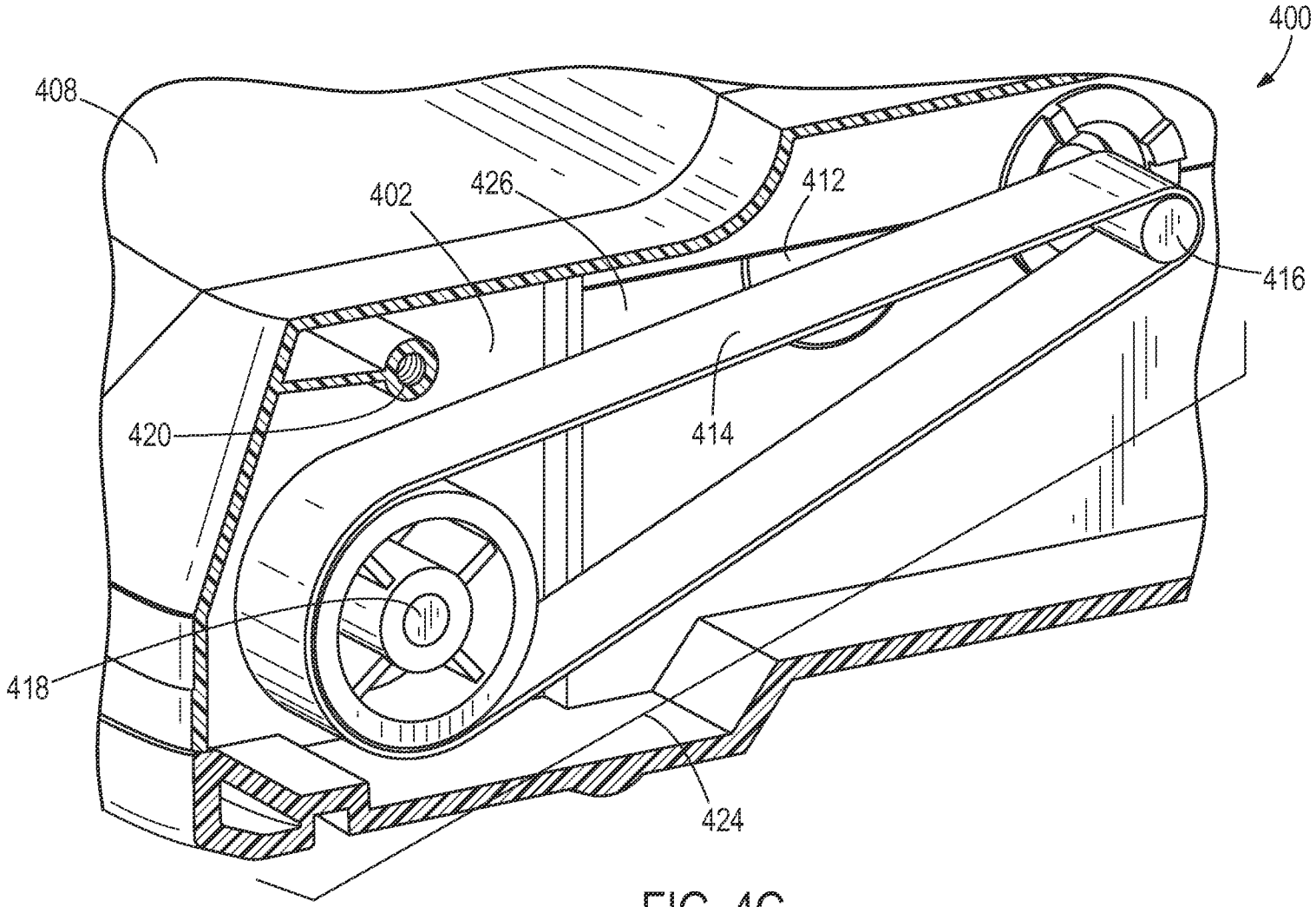

FIGS. 4A-4C are perspective views of an exemplary embodiment of a vacuum cleaner 400. FIG. 4A illustrates vacuum cleaner 400 comprising vacuum cleaner housing 408, comprising a belt housing (not shown). In this embodiment, belt housing cover 402 is affixed to vacuum housing 408 by fastener 406. Belt housing air intake 422 comprises multiple vents 404 to allow air into belt housing cover 402. FIG. 4B illustrates an interior view of vacuum cleaner 400 comprising vacuum housing 408 and belt housing 424. Belt housing 424 comprises belt housing cover 402 and belt housing interior wall 426. Drive belt 414 is positioned on drive belt shaft 416 and beater bar shaft (not shown). Rotation of drive belt shaft 416 can turn drive belt 414, thereby causing beater bar 410 to rotate. In this example, a belt housing duct 426 can be defined by belt housing air intake 422 to belt housing air exhaust 412, as well as belt housing interior wall 426 and belt housing cover 402. Air flow caused by cooling fan (not shown) draws air in through vents 404 located in belt housing air intake 422, through and across belt housing duct 426 and out belt housing air exhaust 412, where the air can subsequently cool the vacuum motor (not shown). FIG. 4C also illustrates an interior cutaway view of vacuum cleaner 400 comprising vacuum housing 408 and belt housing 424. Belt housing 424 comprises belt housing cover 402 and belt housing interior wall 426. Belt housing cover 402 is affixed to belt housing interior wall 426 via fasteners (not shown) and fastener receivers 420. Drive belt 414 is positioned on drive belt shaft 416 and beater bar shaft 418. Rotation of drive belt shaft 416 can turn drive belt 414, thereby causing beater bar shaft 418 to rotate beater bar (not shown).

The belt housing can comprise any suitable material, such as thermoplastics, metals, or combinations thereof Examples of thermoplastics include, but are not limited to, acrylic (PMMA), celluloid, cellulose acetate, cyclic olefin copolymer (COC), ethylene-vinyl acetate (EVA), ethylene vinyl alcohol (EVOH), fluoroplastics (PTFE, FEP, PFA, CTFE, ECTFE, ETFE, etc.), liquid crystal polymer (LCP), polyoxymethylene (POM or acetal), polyacrylates, polyacrylonitrile (PAN or acrylonitrile), polyamide (PA or nylon), polyamide-imide (PAI), polyaryletherketone (PAEK), polybutadiene (PBD), polybutylene (PB), polybutylene terephthalate (PBT), polycaprolactone (PCL), polychlorotrifluoroethylene (PCTFE), polyethylene terephthalate (PET), polycyclohexylene dimethylene terephthalate (PCT), polycarbonate (PC), polyhydroxyalkanoates (PHAs), polyketone (PK), polyester, polyethylene (PE), polyetheretherketone (PEEK), polyetherketoneketone (PEKK), polyetherimide (PEI), polyethersulfone (PES), chlorinated polyethylene (CPE), polyimide (PI), polylactic acid (PLA), polymethylpentene (PMP), polyphenylene oxide (PPO), polyphenylene sulfide (PPS), polyphthalamide (PPA), polypropylene (PP), polystyrene (PS), polysulfone (PSU), polytrimethylene terephthalate (PTT), polyurethane (PU), polyvinyl acetate (PVA), polyvinyl chloride (PVC), polyvinylidene chloride (PVDC), and styrene-acrylonitrile (SAN), as well as combinations thereof.

Examples of metals include, but are not limited to stainless steel, low alloy steels, titanium, cobalt chromium, copper, nickel, magnesium, and ceramics such as alumina, zirconia, silicon carbide, and silicon nitride, as well as combinations thereof The belt housing can be made in any suitable manner including injection molding and/or thixomolding.

The drive belt can be flat, v-belts, grooved, notched, toothed, or cogged. Further, drive belt can be made from any suitable material. Suitable materials include, but are not limited to plastics, rubber, polymers, and leather. Examples include polyvinyl chloride, urethane, fiberglass, silicone, acetal, polypropylene, polyethylene, Kevlar™ (Dupont).

As mentioned above, the filter cover can be secured to the belt housing cover by tabs. The filter cover can have a single or multiple apertures which allow air to flow into the belt housing air duct. The apertures may be in any suitable shape, including circular, square, oval, elliptical, hexagonal, honeycomb, etc. The filter media can be made of any suitable material or combination of materials. For example, filter media can be, without limitation, fiberglass, polyester, cotton, carbon, paper, or a "High Efficiency Particle Air" (HEPA). Additionally, the filter media can be replaceable or washable.

In general, a drive belt has an average MTBF of approximately 100-150 hours. Drive belts used within a belt housing as disclosed herein can have an MTBF of over 500 hours. The drive belts used within a belt housing a described herein can have an MTBF greater than the operational MTBF of the rest of the vacuum cleaner 100. Additionally, the drive belts used within a belt housing described herein can have an MTBF greater than the operational MTBF of other replaceable parts of the vacuum For example, the approximate MTBF of a standard beater bar/brush roll is approximately 300 hours before failure due to loss or breakage of bristles. The operational MTBF of a drive belt disposed within a drive belt housing described herein can increase at least about 5, 10, 20, 30 or 40% as compared to an operational MTBF of an identical drive belt not disposed within drive belt housing.

EXAMPLE

The following example is given by way of illustration only and is not intended to limit the scope of the invention in any way.

Example 1

Figure 3:
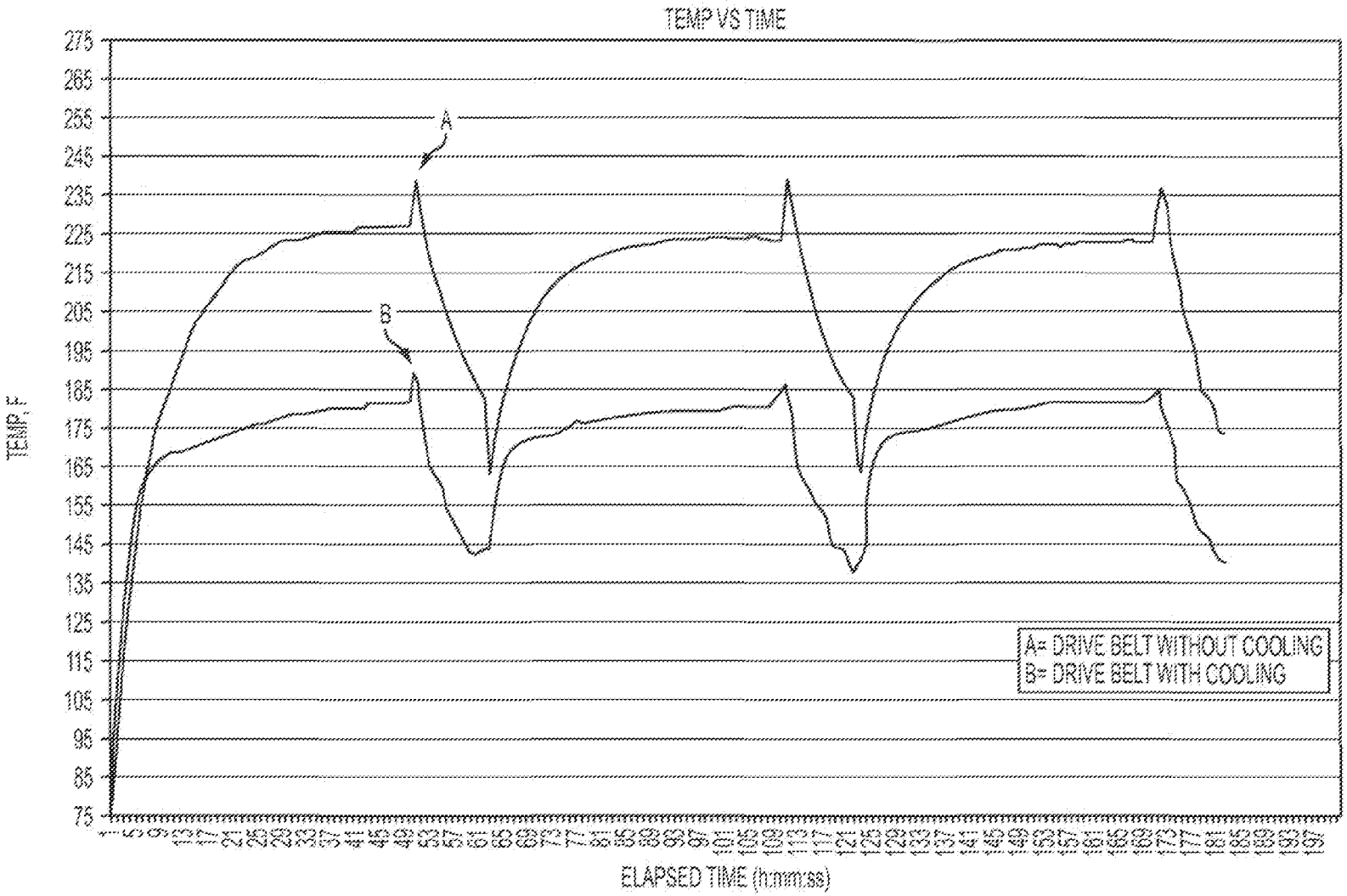
FIG. 3 illustrates a graph depicting the cooling effect of a belt housing according to one embodiment.

Tests determining the cooling characteristics of a belt housing according to one embodiment can be seen in FIG. 3. "A" represents the temperature within a vacuum housing area proximate a new belt without a cooling belt housing. "B" represents the temperature proximate a new belt within a belt housing area with air intake and exhaust vents with cooling. The temperature proximate to the area of "B" belt is below that of the non-cooled "A" belt. Surprisingly, further testing showed that cooling effects were not significant in belt housing areas where large holes or entire portions of the belt housing were removed (data not shown).

The various embodiments described above are provided by way of illustration only and should not be constructed to limit the invention. Those skilled in the art will readily recognize the various modifications and changes which may be made to the present invention without strictly following the exemplary embodiments illustrated and described herein, and without departing from the true spirit and scope of the present invention, which is set forth in the following claims.

What is claimed is:

1. A vacuum cleaner comprising:

a base housing;

a motor including a shaft adapted to receive a drive belt, wherein the motor is disposed in the base housing; and a drive belt housing including an opening to receive the shaft, a drive belt housing air exhaust, and a drive belt housing air intake offset from the drive belt housing air exhaust in a length direction of the drive belt, wherein an air flow path defined between the drive belt housing air intake and the drive belt housing air exhaust overlaps the drive belt.

2. The vacuum cleaner of claim 1, further comprising a cooling fan disposed on the shaft.

3. The vacuum cleaner of claim 1, further comprising a cooling fan, and wherein the shaft extends from both ends of the motor, the cooling fan is disposed on one end of the motor and the drive belt housing is disposed on the other end of the motor.

4. The vacuum cleaner of claim 2, further comprising an impeller disposed on the shaft.

5. The vacuum cleaner of claim 1, further comprising a drive belt and a beater bar driven by the drive belt.

6. The vacuum cleaner of claim 1, further comprising a motor support disc disposed proximate to the drive belt housing air exhaust.

7. The vacuum cleaner of claim 1, wherein the belt housing comprises magnesium.

8. The vacuum cleaner of claim 1, further comprising a filter disposed on the belt housing air intake.

9. The vacuum cleaner of claim 8, wherein the filter is removable.

10. The vacuum cleaner of claim 8, wherein the filter is washable.

11. The vacuum cleaner of claim 1, further comprising a base housing exhaust for exhausting air from within the base housing to the environment, wherein the air flow path is further defined from the drive belt housing air exhaust to the base housing exhaust.

12. The vacuum cleaner of claim 1, wherein an operational Mean Time Between Failure (MTBF) of a drive belt is greater than the operational MTBF of the rest of the vacuum.

13. The vacuum cleaner of claim 1, wherein an operational MTBF of a drive belt disposed within the drive belt housing increases at least 30% as compared to an operational MTBF of an identical drive belt not disposed within the drive belt housing.

14. The vacuum cleaner of claim 1, wherein the vacuum cleaner is an upright vacuum cleaner.

15. The vacuum cleaner of claim 1, wherein the drive belt housing includes a duct that provides a small clearance between internal walls of the duct and the drive belt.

16. A process of cooling a vacuum cleaner belt disposed in a vacuum cleaner, the process comprising:

providing a vacuum cleaner base housing including a base housing air intake;

providing a motor comprising a shaft adapted to receive a drive belt and a cooling fan, wherein the motor is disposed in the vacuum cleaner base housing;

providing a drive belt housing including an opening to receive the shaft, a drive belt housing air exhaust disposed proximate the opening and a drive belt housing air intake disposed remote from the opening;

cooling the drive belt by having an air flow into the drive belt housing air intake, over the drive belt, and out through the drive belt housing air exhaust; and communicating the air flow from the drive belt housing air exhaust to the motor.

17. The process of claim 16, wherein the air flows across the width of the drive belt.

18. The process of claim 16, wherein the air flows along the length of the drive belt.

19. A vacuum cleaner comprising:

a base housing defining an interior space;

a motor at least partially disposed within the interior space;

a drive belt driven by the motor;

a drive belt housing at least partially surrounding the drive belt, the drive belt housing including an air intake for introducing ambient air into the drive belt housing to cool the drive belt, and an air exhaust for exhausting the ambient air into the interior space.

* * * * *